United States Patent [19]

Matsumoto et al.

[11] Patent Number: 4,553,851

[45] Date of Patent: Nov. 19, 1985

[54] TIMEPIECE OPERATED BY SOLAR CELLS

[75] Inventors: Akio Matsumoto; Takao Yamada, both of Neyagawa, Japan

[73] Assignee: Matsushita Electric Works, Ltd., Osaka, Japan

[21] Appl. No.: 558,870

[22] Filed: Dec. 7, 1983

[30] Foreign Application Priority Data

Dec. 28, 1982 [JP] Japan ..... 57-229483

[51] Int. Cl.[4] ..... G04B 1/00

[52] U.S. Cl. ..... 368/205; 368/203; 368/204

[58] Field of Search ..... 368/203–205; 136/243, 244, 246, 259

[56] References Cited

FOREIGN PATENT DOCUMENTS

| | | | |
|---|---|---|---|
| D21627 | 10/1956 | Fed. Rep. of Germany | 368/204 |
| 0027074 | 3/1978 | Japan | 368/205 |
| 411709 | 11/1966 | Switzerland | 368/204 |
| 1545455 | 5/1979 | United Kingdom | 368/205 |

*Primary Examiner*—Ulysses Weldon
*Attorney, Agent, or Firm*—Koda and Androlia

[57] ABSTRACT

A timepiece operated by solar cells wherein the timepiece includes a base plate defining thereabove a base with a time indicator. Mounted on the base plate is a driver for driving the time indicator. A plurality of circumferentially spaced solar cells are also mounted on the base plate for energizing the driver to drive the time indicator. The solar cells employed are respectively flat-shaped ones, each having a light sensitive surface on its one of two major surfaces, and are spaced circumferentially in a loop within a plane parallel with the base plate. A light guide is mounted on the base plate for transmitting incident light to the light sensitive surface of each solar cell through a deviated or deflected path for the purpose of giving greater design flexibility in the arrangement of the solar cells within a limited space of the timepiece, while retaining maximum light collecting efficiency.

9 Claims, 41 Drawing Figures

TIMEPIECE OPERATED BY SOLAR CELLS

BACKGROUND OF THE DISCLOSURE

1. Fields of the Invention

This invention is directed to a timepiece operated by solar cells, more particularly to a timepiece having a light guide means which transmits incident light to each of a plurality of solar cells incorporated within the timepiece to operate the same.

2. Description of the Prior Art

There have been provided a large variety of timepieces of the type powered by solar cells, one example of such prior devices being illustrated schematically in FIG. 1 in which a plurality of flat-shaped solar cells 2 are arranged circumferentially along the periphery of the casing 1 with each light sensitive surface facing upwardly to attain maximum efficiency of receiving incident light. As is seen from the above, there should be a certain restriction in the structural design of such prior device that each light sensitive surface which is one of the major surfaces of each flat-shaped solar cell has to be in a plane parallel with the top face so as to receive the rays of incident light as much as possible. Due to this structural restriction, there have been less freedom in the choice of the location or space for the solar cells, rendering the devices to have an almost uniform appearance. In other words, such prior devices could not be allowed to have a bold design turnover or substantial design flexibility, which is highly desired to obtain a compact arrangement of the timepiece with the solar cells. In fact, the device of FIG. 1 requires much space in the peripheral portion thereof for mounting the solar cells 2, which will certainly result in the increase in the plane dimension. The above prior device has another critical disadvantage that the connecting lines 3, which should be required to derive the electric power from the solar cells 2 and therefore be connected at the respective ends directly to the light sensitive surfaces of the solar cells 2, can be clearly seen and therefore be certainly a cause to mar the appearance of the timepiece.

SUMMARY OF THE INVENTION

The above disadvantages or drawbacks have been eliminated by the present invention which adopts a light guide means to transmit incident light in a deviated or deflected path to each of circumferentially spaced solar cells. A timepiece in accordance with the present invention includes a base plate defining thereabove a face of the timepiece, a time indicating means on the face, and a drive means powered by the solar cells to operate the time indicating means. The solar cells are mounted on the base plate and spaced circumferentially to form a loop within a plane parallel with the base plate, so that the sufficient number of the solar cells are incorporated within the thickness of the timepiece to produce enough electric power for operating the time indicating means. The above light guide means is mounted on the base plate, and has a light entrance surface exposed to the top surface of the timepiece for receiving incident light, at least one reflection surface for reflecting the incident light, and at least one light exit surface which confronts closely the light sensitive surface of each solar cell for transmitting thereto the incident light reflected from the reflection surface. Thus, the incident light is reflected at least once on the reflection surface of the light guide means so as to be transmitted in the deviated path to successfully reach the solar cells. With this light guide means, the solar cells are no more required to be disposed at the limited location of being directly exposed to the outer surface, usually the top surface, of the timepiece, and therefore can be incorporated at a location free from such limitation to give far greater design flexibility, whereby the timepiece can be so constructed as to have a compact arrangement by suitably choosing a space within the timepiece for the solar cells without giving a thought to that limitation.

Accordingly, it is a primary object of the present invention to provide a timepiece operated by solar cells which is capable of having greater design flexibility in determining the space for the solar cells and is most appropriate to be constructed in a compact size.

In a preferred embodiment of the present invention, there is disclosed a terminal means which extends along the loop of the solar cells to derive electric power therefrom for operating the time indicating means. Said terminal includes first and second terminal areas which are connected respectively to the light sensitive surface and the opposed surface of each solar cells. Interconnecting the respective light sensitive surfaces and the first terminal area are lead wires each of which should be connected at its one end to the corresponding light sensitive surface. An improvement of the invention resides in that the connection between each lead wire and the terminal means are out of confronting relationship with said light exit surface of the light guide means, such that any connection member connected to the light sensitive surface of each solar cell can not be seen through the light guide means, while the sufficient amount of incident light being allowed to enter each solar cell.

It is therefore another object of the present invention to provide a timepiece operated by solar cells in which the lead wires connected to the light sensitive surface of each solar cell can be arranged to be out of sight for presenting a good appearance.

Also disclosed in the present invention is a useful and effective arrangement of the solar cells. A plurality of the flat-shaped solar cells are spaced circumferentially along the periphery of the face of the timepiece with the major surfaces of each cell being perpendicular to and in the radial directions of the base plate. A reflecting prism extending likewise along the periphery of the face is utilized as the light guide with its light entrance surface facing upwardly and with its light exit surface confronting the light sensitive surface of each solar cell. This arrangement of the solar cells and the light guide means enables the timepiece to incorporate the solar cells in number enough to produce the power for operating the timepiece and within a minimum plane dimension thereof, so that the timepiece can be compacted in size, particularly with respect to the radial dimension.

It is a further object of the present invention is to provide a timepiece which is compact yet assures sufficient electric power to be produced in the whole solar cells.

The present invention further includes a flexible printed wiring of unique configuration which is adopted as said terminal means for the solar cells. The flexible printed wiring comprises a flexible band with the printed terminal segments to which each solar cell is connected electrically as well as mechanically. Thus, the solar cells held and arranged in a row on the flexible printed wiring can be easily adapted or flexed to extend along the periphery of the face of the timepiece. Also with this arrangement, the spacing between selective pairs of adjacent solar cells can be utilized to define time indicias, which can be seen through the light guide means, or appear on the top face of the timepiece. Such spacings defining the time indicias are made remarkable by being tinted in a color different from that of the solar cells.

Consequently, it is a still further object of the present invention to provide a timepiece operated by solar cells in which a plurality of the solar cells can be easily positioned in place and in which time indicias can be represented by making the best of the spacings between the adjacent solar cells.

In the present invention, there are disclosed still other advantageous features which will serve to present a compact arrangement, particularly with respect to the thickness of the timepiece. These and above advantageous features will be more apparent from the following detailed description of the present invention taken with the accompanying drawings.

DETAILED DESCRIPTION OF THE PREFERRED EMBODIMENT

Figure 1:
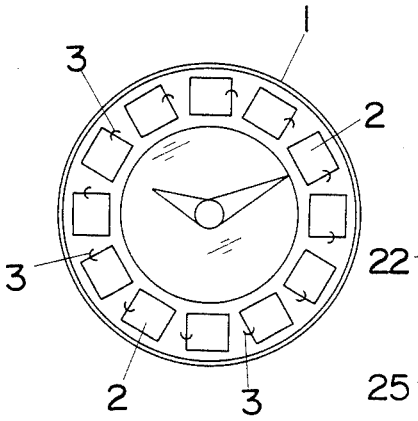
Fig. 1 (PRIOR ART)
FIG. 1 is a somewhat diagrammatic view of a prior timepiece with solar cells.
Figure 2:
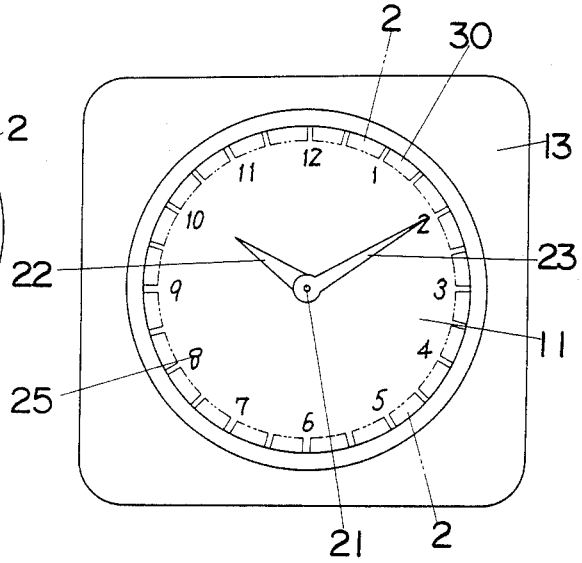
FIG. 2 is a plane view of a timepiece operated by solar cells in accordance with a first preferred embodiment of the present invention.

Referring now to the drawings and particularly to FIGS. 2 through 8, there is illustrated a first preferred embodiment of a timepiece which comprises a rectangular base plate 10 provided at its center portion with a drive means 20, a circular face plate 11 of opaque material disposed above the base plate 10, a transparent top cover 12 with a light guide means 30 extending circumferentially along the entire periphery thereof, an escutcheon frame 13 for securing the top cover 12 to the base plate 10, and a plurality of flat-shaped solar cells 2 mounted on the base plate 10. Said drive means 20 is an electrically powered movement having a stepper motor (not shown) and an upright output drive shaft 21 for operating a time indicating means, which comprises at least a hour hand 22 and a minute hand 23 overlying said face plate 11. The movement 20 is encapsulated in a shallow case 24 which is received in the center bore 14 of the base plate 10 with the drive shaft 21 being in coincidence with the upright center axis of the base plate 10, and is supplied with an electric power from the solar cells 2 to rotate the hour hand 22 and the minute hand 23 about the drive shaft 21. Also included in said case 24 are a rechargeable battery (not shown) connected in parallel with the solar battery composed of said solar cells 2 to be charged thereby for operating the movement when the solar cells 2 are not available, and a protective circuit (not shown) connected between the above two batteries for preventing the rechargeable battery from being overcharged.

Figure 4:
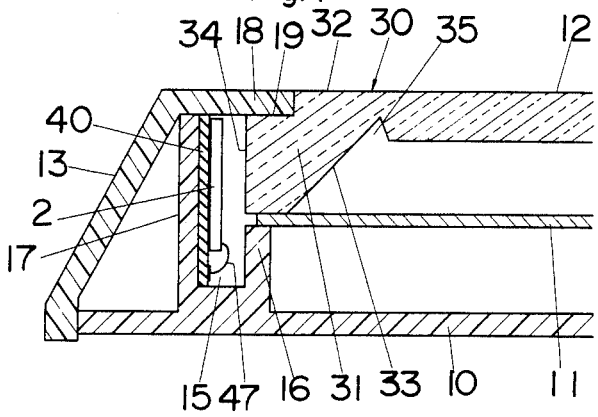
FIG. 4 is an enlarged sectional view illustrating solar cells and light guide means to transmit incident light thereto employed in the above embodiment.

Said base plate 10 is provided in the upper surface with a peripheral annular groove 15 for receiving a plurality of said solar cells 2 together with a flexible printed wiring 40 carrying the cells 2. The annular groove 15 is concentric with said drive shaft 21 and defined between a pair of upwardly extending integral ribs 16 and 17, the inner rib 16 of which is formed to have less height than the outer rib 17 and bears at its upper end the face plate 11 and the top cover 12, as best shown in FIG. 4. The base plate 10 is snugly fitted within the lower opening of the escutcheon frame 13 with the upper end of said outer rib 17 being in abutting engagement with an internal flange 18 at the upper end of the escutcheon frame 13, as the innermost portion of said flange 18 is fitted within a recess 19 at the outer periphery of the top cover 12 to hold the same between the flange 18 and said inner rib 16.

Figure 5:
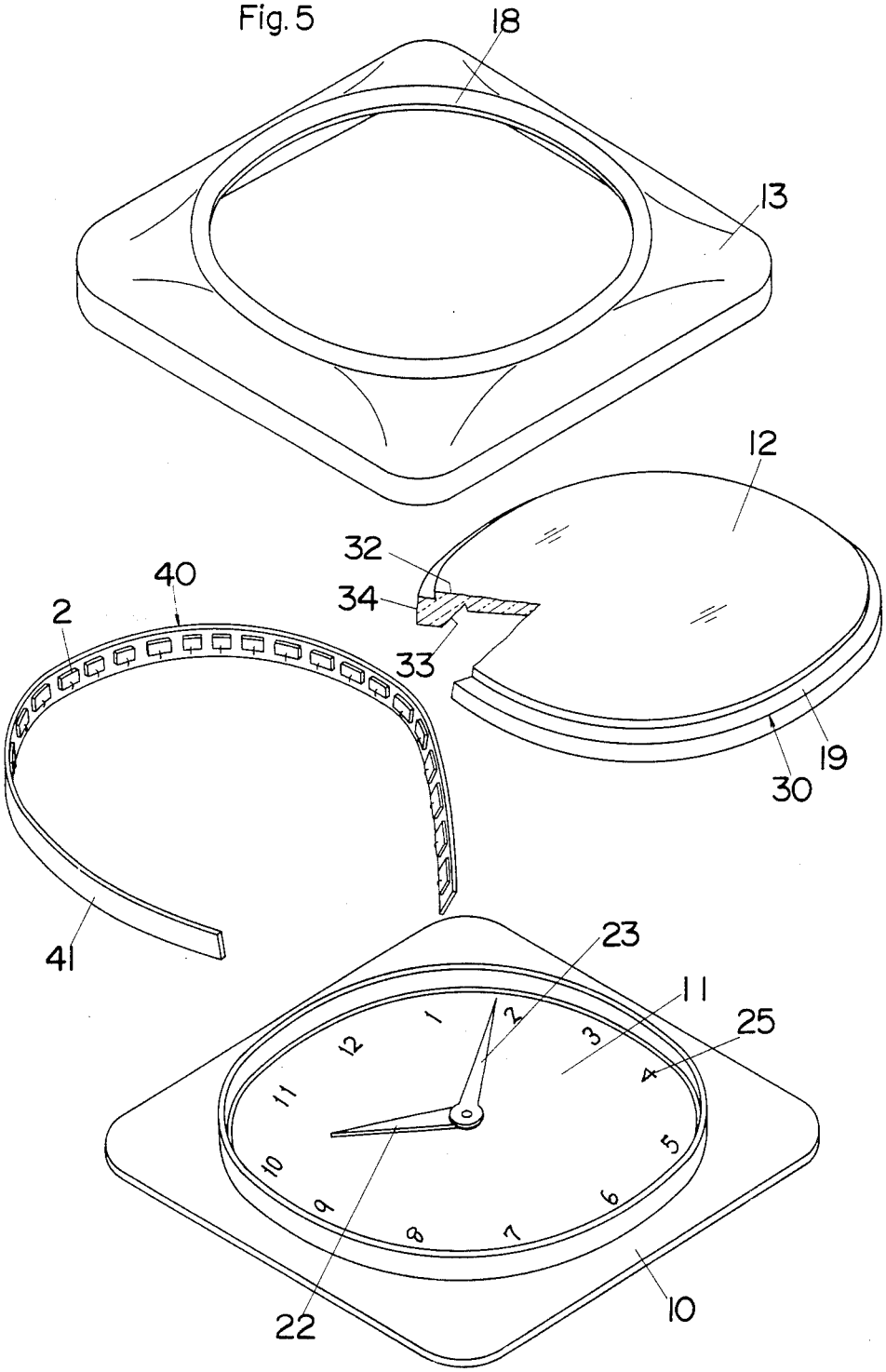
FIG. 5 is an exploded view illustrating the parts constituting the above timepiece.
Figure 6:
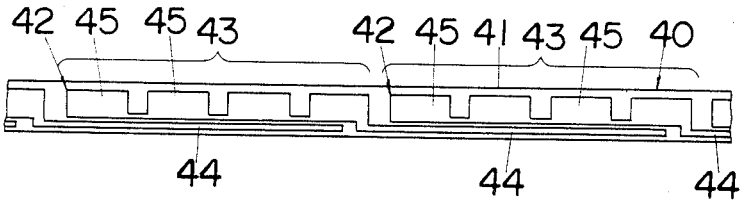
FIG. 6 is a partial view illustrating a flexible printed wiring employed as a terminal for the solar cells in the above embodiment.
Figure 7:
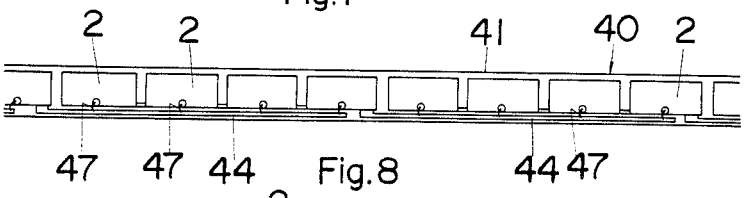
FIG. 7 is a partial view illustrating the spacing arrangement of the solar cells on the above flexible printed wiring.
Figure 8:
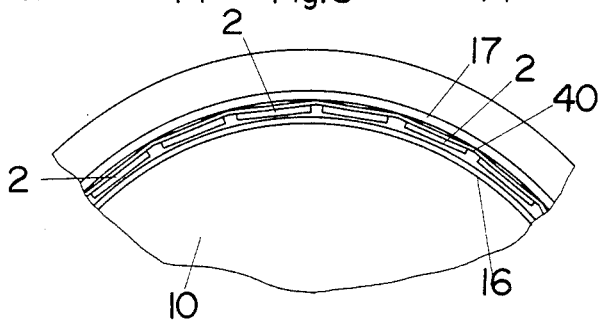
FIG. 8 is a partial plane view illustrating the part of the above flexible printed wiring in its mounted position on a base plate of the above timepiece.

Referring to FIGS. 5 through 7, said flexible printed wiring 40, which carries the solar cells 2 in a row, serves as a terminal means for connection with said drive means or movement 20, and is connected thereto by means of wires 28 in this embodiment. The flexible wiring 40 comprises a flexible band 41 of electrically insulating material on one side of which are printed a plurality of elongated terminal segments 42 for connecting the solar cells 2 both in parallel and series. Each terminal segment 42 consists of a first terminal area 44 of relatively narrow pattern and a second terminal area 43 of relatively wide pattern, from one longitudinal and lower end of which is extended longitudinally said first terminal area 44, as best shown in FIG. 6. The second terminal area 43 is further formed to have a serrated pattern in which a series of tabs 45 connected only at their lower extremities by respective lines to the adjacent ones so as to define spacings between the adjacent tabs 45. The arrangement of said terminal segments 42 on the flexible band 41 is such that said first terminal area 44 of each segments 42 is spaced below the second terminal area 43 of the adjacent segment 42. It is between each tab 45 and the first terminal area 44 just therebelow that each solar cell 2 is electrically connected, whereby the groups of parallel-connected solar cells, each having the cells 2 equivalent in number to that of the tabs 45 in each second terminal area 43, are connected in series with each other to obtain enough electric power for operation of said movement 20. Each solar cell 2 is secured to the corresponding tab 45 by means of adhesive resin of electrically conductive nature or a solder with its light sensitive surface exposed in such a manner as to fully cover the the corresponding tabs 45, as lead wire 47 bridging or interconnecting the lower extremity of the light sensitive surface of each solar cell 2 and the corresponding portion on the first terminal area 44. One solar cell 2 connected at the one longitudinal end of the flexible printed wiring 40 is linked to the opposite end thereof to form it into an annular flexible band, the lower end portion of which is received within said annular groove 15 in the base plate 10. In this position, the non conductive surface of the flexible printed wiring 40 is urged against said outer rib 17 by its resilient force expanding radially outwardly so as to place each solar cell 2 in position. Also in this position, most of the light sensitive surface of each solar cell 2 is positioned above the face plate 11 to receive incideht light through said light guide means 30, while the lower extremity of each light sensitive surface having the associated lead wire 47 connected thereto is concealed within the groove 15 such that this connection cannot appear on the light guide means 30.

Figure 9:
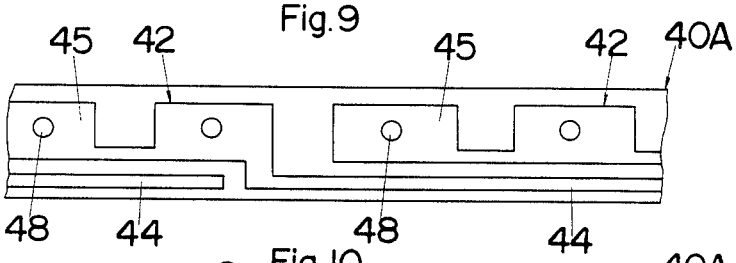
FIG. 9 is a partial view illustrating a modified flexible printed wiring which can be adapted in the above embodiment.
Figure 10:
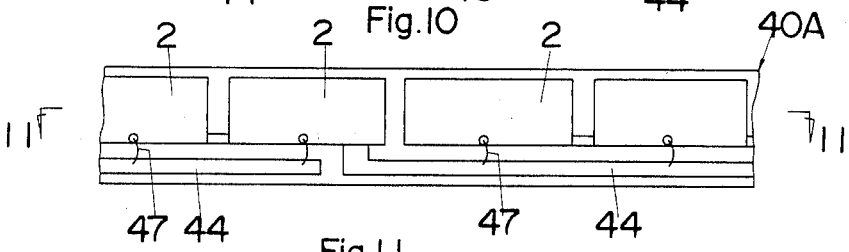
FIG. 10 is a partial view illustrating the electrical connection of the solar cells on the flexible printed wiring of FIG. 9.
Figure 11:
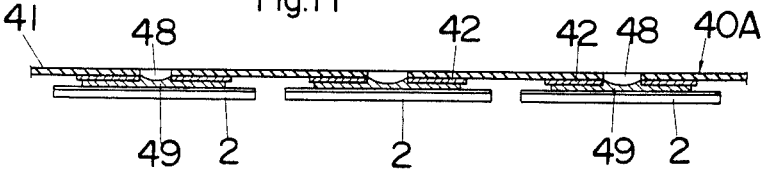
FIG. 11 is a cross section taken along line 11—11 of FIG. 10.

FIGS. 9 and 10 show another flexible printed wiring 40A which is similar in the arrangement of the terminal segments 42 to the above described one except that each tab 45 has a throughhole 48 through which the solder 49 is introduced to bond each solar cell 2 to the corresponding terminal segment 42. The solder 49 filled through the throughholes 48 will reach the substantial area of the back side of each solar cell 2 by capillarity to effect secure bonding.

Figure 3:
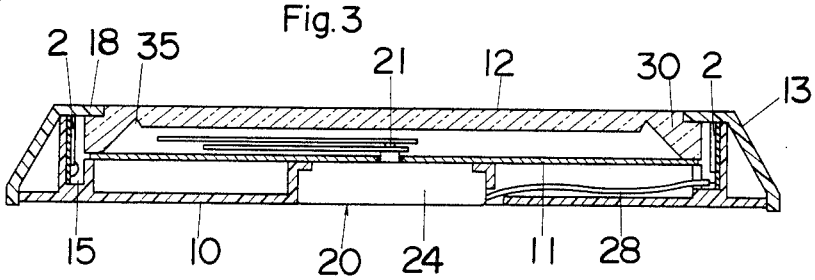
FIG. 3 is a vertical sectional view of the above timepiece.

As illustrated in FIGS. 3 through 5, said light guide means 30 in this embodiment is a reflecting prism integrally formed with the circular top cover 12. The top cover 12 is formed by transparent material such as by acrylate and polycarbonate to have on its under surface an integral projection 31 which extends along the entire periphery thereof in a concentric manner with the center axis of the base plate 10 to define the above reflecting prism 30 having an light entrance surface 32 on the top face, a reflection surface 33, and a light exit surface 34 on its outer side face. It is this light exit surface 34 that confronts each of said solar cells 2 in parallel relationship therewith so as to transmit to each solar cell 2 the incident light which enters through the light entrance surface 32 and is then reflected from the reflection surface 33. That is, the incident light falling on the light entrance surface 32 advances through a deviated or deflected path in the reflecting prism 30 to illuminate each solar cell 2 for being converted into electric energy thereat. This deviated or deflected path in which the incident light undergoes permits the solar cells 2 to be incorporated in the timepiece without giving a thought to the direction of the light sensitive surfaces, and therefore allows a relatively free choice of location or room for the solar cells 2 to be incorporated within the housing of the timepiece, enabling the timepiece to be constructed in compact. In fact, the solar cells 2 are arranged in this embodiment to surround the face plate 11 with the light sensitive surfaces being vertically disposed and not horizontally, such that there required less space or room with respect to the radial dimension of the timepiece for accommodating the solar cells 2 in the peripheral portion thereof, as compared to the case when they are disposed with the light sensitive surfaces being disposed horizontally, which result in reducing the radial dimension of the timepiece. Also, in this embodiment the lead wires 47 respectively connected to the light sensitive surfaces of the solar cells 2 are out of confronting relationship with the light exit surface 34, so that the lead wires 47 cannot be seen through the reflecting prism 30 and cannot appear on the top cover 12. This is most advantageous in view of providing good appearance of the timepiece.

As illustrated in FIG. 4, said top cover 12 is provided in its lower surface with a V-shaped notch 35 which extend along the entire periphery of the reflecting prism 30 at the portion inwardly thereof to have the opposed oblique sides. The outer oblique side of the two are coplanar and cooperative with the oblique face of said projection 31 so as to define said reflection surface 33, the vertical component of which is equal to that of the light exit surface 34. With the result of this, the substantial portion the light sensitive surface of each solar cell 2 can be subjected to the incident light without reducing the thickness of the portion other than the reflecting prism 30 of the top cover 12, that is, without weakening the mechanical strength of that portion, while maintaining the whole thickness of the top cover 12 including the reflecting prism 30 at minimum, which is most required for the timepiece with a reduced thickness.

Figure 12:
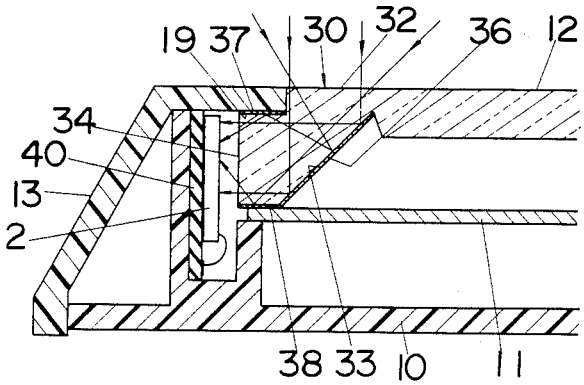
FIGS. 12 through 15 are partial views in section respectively illustrating the modifications of the above embodiment.
Figure 13:
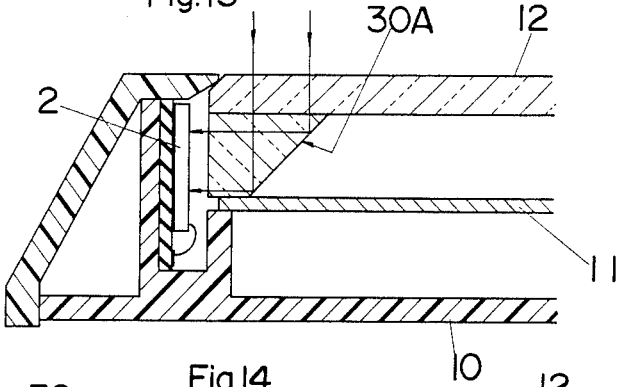

In the above embodiment as well as in the following two modifications as illustrated in FIGS. 12 and 13, the face plate 11 is provided on its upper surface with time markings 25 which are located inwardly of the contacting area between the reflecting prism 30 and the face plate 11 to be viewed through the top cover 12.

The modification of the above embodiment illustrated in FIG. 12 includes separate or additional specular reflectors 36, 37, and 38 which respectively cover said reflection surface 33, the bottom surface of said recess 19, and the lower flat surface of the reflecting prism 30 to enhance specular reflection factors at the respective surfaces for raising the efficiency in gathering the rays of incident light onto each solar cell 2. These specular reflectors are preferably a metal foil attached to the respective surfaces, a film formed by evaporating or spattering of metal on such surfaces. The last two specular reflectors 37 and 38 are particularly important since they positively define first and second additional reflection surfaces at respective surfaces which are in contact with the escutcheon frame 13 and the face plate 11, and thus have the possibility of failing to be good reflecting surfaces depending upon the materials selected for the escutcheon frame 13 and the face plate 11. With this result, as shown by the arrowed lines in FIG. 12, the reflected light from the oblique reflection surface 33 but deviated from the course toward the solar cell 2 can be again reflected on the first additional reflection surface 37 so as to successfully reach the solar cells 2 as well as the incident light which will miss that reflection surface 33 can be likewise reflected on the second additional surface 38 to successfully enter the solar cells 2.

Figure 14:
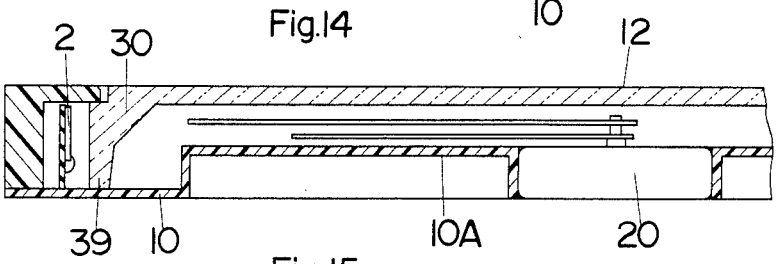
Figure 15:
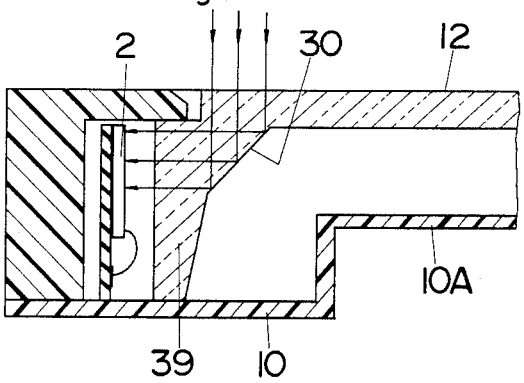

FIG. 13 shows another modification of the above embodiment in which the light guide means is defined by a reflecting prism 30A which is similar in configuration to the above embodiment but to be formed separately from the top cover 12. Further modifications of the above embodiment are disclosed respectively in FIGS. 14 and 15, in which the base plate 10 itself define on its center platform 10A the face of the timepiece and in which integral leg 39 extending downwardly from the reflecting prism 30 of the same configuration as above abuts on the base plate 10 at the portion outwardly of said platform 10A.

Referring to FIGS. 16 through 27, there are disclosed a second preferred embodiment of the present invention and various modifications thereof wherein some of said spacing or gaps between the adjacent solar cells 2 mounted on the flexible printed wiring 40A–40D are utilized to represent time indicias 26 which will appear on the light entrance surface 32 of the reflecting prism 30. The other structural arrangements are similar to the above embodiment.

Figure 16:
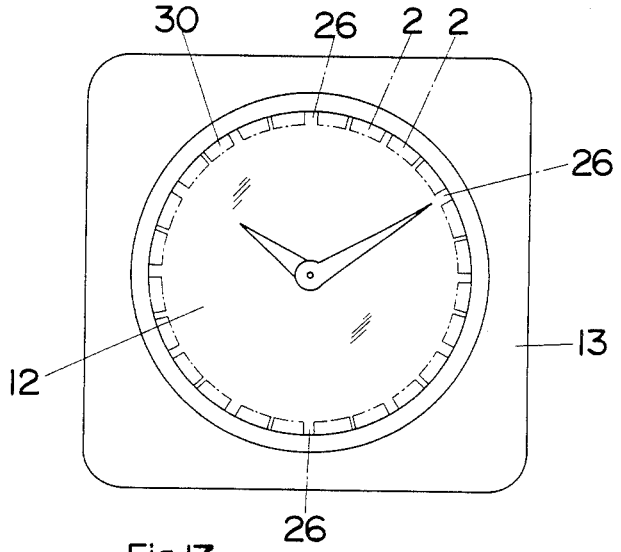
FIG. 16 is a plane view of a second embodiment of the present invention.
Figure 17:
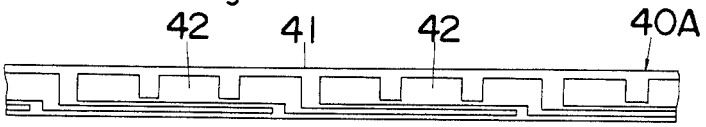
FIG. 17 is a partial view of a flexible printed wiring serving as the terminal for the solar cells.
Figure 18:
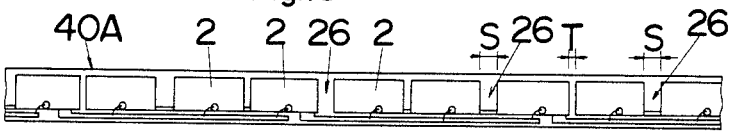
FIG. 18 is a partial view illustrating the spacing arrangement of the solar cells on the above flexible printed wiring.

In the embodiment illustrated in FIGS. 16 through 18, said time indicias 26 are a set of twelve hour representations which are defined by the wider gaps or spacings S rather than the narrower gaps T both occurring repeatedly on the flexible printed wiring 40A. A total number of twenty-four solar cells 2 are mounted on the flexible band 41 in such an electric connection that four groups each consisting of three parallel-connected solar cells 2 are connected in series by means of the terminal segments 42 on the flexible band 41, and at the same time mounted in such a spacing arrangement that each pair of two adjacently disposed solar cells 2 is spaced longitudinally or circumferentially along the flexible band 41 from the adjacent pairs of solar cells 2 at a wider spacing or gap S than that T formed between the solar cells 2 in each pair. These wider gaps S are spaced equally along the entire length of the flexible band 41 to be disposed equiangularly about the center of the timepiece, thus presenting said twelve hour representations which can be seen through the reflecting prism 30. That is, the areas on the flexible band 41 which correspond to the wider gaps S are remarkably seen through the reflecting prism 30 and appear on the light entrance surface thereof to represent the time indicias 26.

Figure 19:
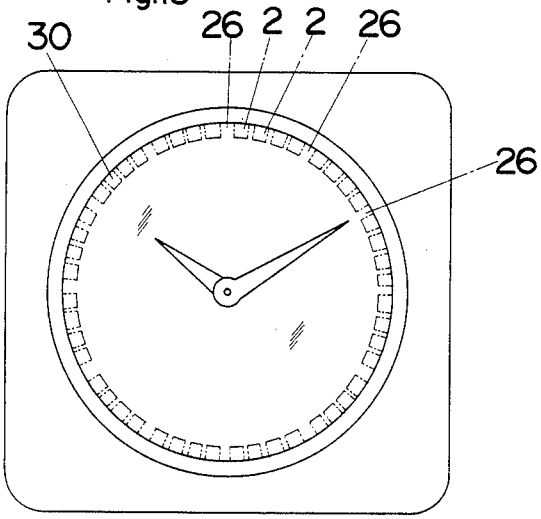
FIG. 19 is a plane view of a first modification of the above second embodiment.
Figure 20:
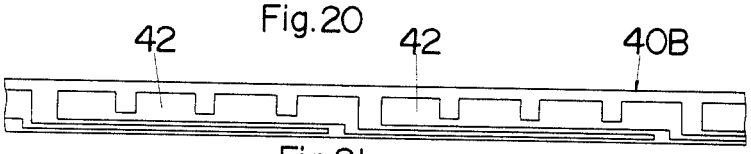
FIG. 20 is a partial view of a flexible printed wiring employed in the above modification of FIG. 19.
Figure 21:
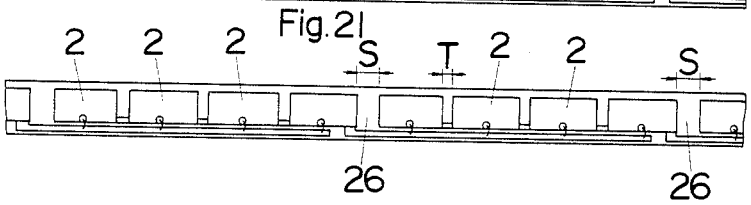
FIG. 21 is a partial view illustrating the spacing arrangement of the solar cells on the printed wiring of FIG. 20.

FIGS. 19 through 21 illustrate a first modification of the above embodiment in which a total number of forty-eight solar cells 2 are mounted on the flexible printed wiring 40B in much the same way as in the above embodiment to provide the hour representations or time indicias 26 by the wider gaps S formed between the groups of the solar cells 2, each group consisting of four parallel-connected solar cells 2 with a narrower spacing or gap T therebetween.

Figure 22:
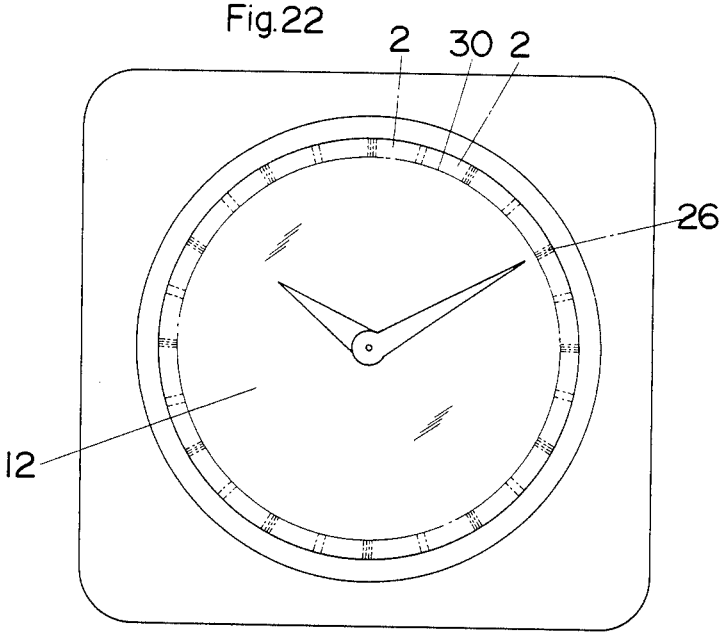
FIG. 22 is a plane view of a second modification of the above second embodiment.
Figure 23:
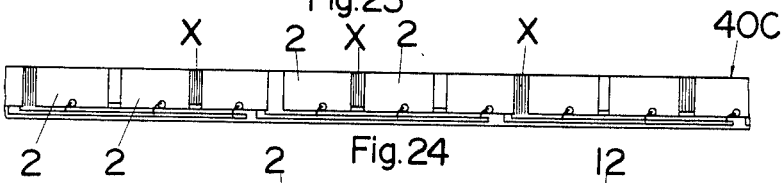
FIG. 23 is a partial view illustrating the spacing arrangement of the solar cells on a flexible printed wiring employed in the above modification of FIG. 22.

Illustrated in FIGS. 22 and 23 is a second modification of the above embodiment in which twenty-four solar cells 2 are uniformly spaced on the flexible printed wiring 40C and in which every second gap between the adjacent solar cells 2, more exactly the area on the flexible band 40 corresponding to such every second gap, is tinted in a distinguishing color, while the solar cells 2 and the remaining gaps are tinted in a neutral color. This makes the gaps X in such distinguishing color to define the hour representations or time indicias 26 which can be viewed distinguishedly on the light entrance surface of the reflecting prism 30.

Figure 24:
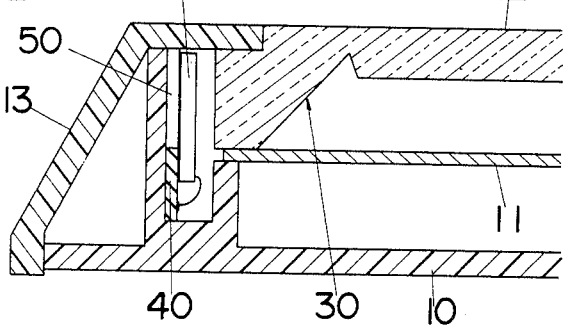
FIG. 24 is a sectional view of a third modification the above second embodiment.
Figure 25:
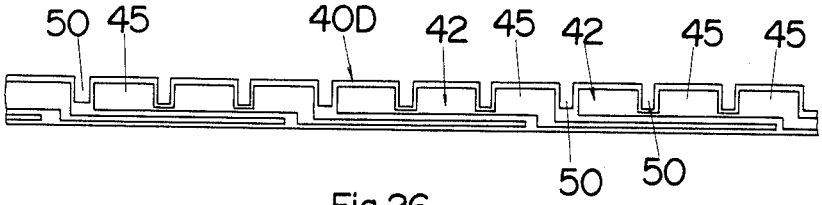
FIG. 25 is a partial view of a flexible printed wiring employed in the above modification of FIG. 24.
Figure 26:
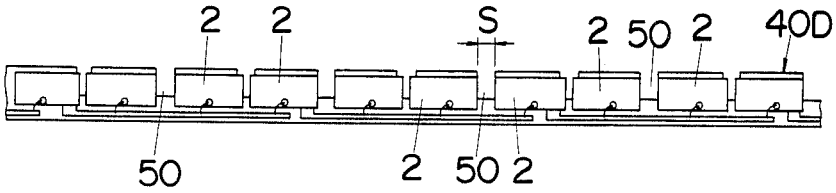
FIG. 26 is a partial view illustrating the spacing arrangement of the solar cells on the above flexible printed wiring.
Figure 27:
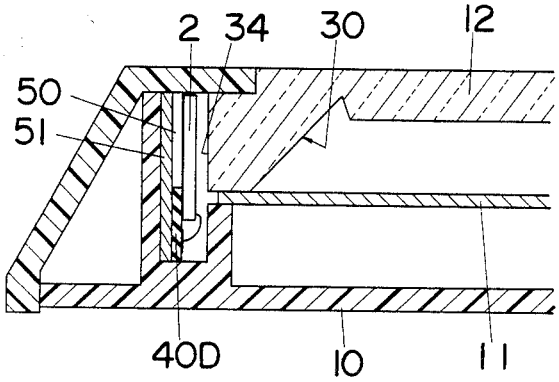
FIG. 27 is a partial view in section of a further modification of the above embodiment.

A third modification of the above embodiment is illustrated in FIGS. 24 through 26, wherein the time indicias 26 are defined by cutouts 50 formed in the flexible printed wiring 40D which is similar in the arrangement of the terminal segments 42 to those employed in the above embodiments except for that cutouts 50. The cutouts 50 are formed in the upper half of the flexible band 41 at the respective portions between the tabs 45 within the same terminal segment 42 and between the tabs 45 of the adjacently disposed terminal segments 42. Cooperative with these cutouts 50 are the solar cells 2 which are mounted on the flexible printed wiring 40 to close substantially every second cutout 50 while leaving the remaining every second cutout 50 fully open, as shown in FIG. 26. That is, the spacing of the solar cells 2 is such that a wider gap occurs S at every second spacing to open the corresponding cutout 50, through which said outer rib 17 of the base plate 10 is exposed to face the light exit surface 34 of the reflecting prism 30. The inner surface of that outer rib 17 is tinted in a distinguishing color which is in contrast to that of the solar cells 2, presenting time indicias 26 at the areas corresponding to and defined by the cutouts 50 which communicate with the respective wider gaps S. For this purpose, the outer rib 17 may be of course painted, or itself made of material colored in such distinguishing color, or may be covered on its inner surface by sheet 51 of such color, as shown in FIG. 27.

Figure 28:
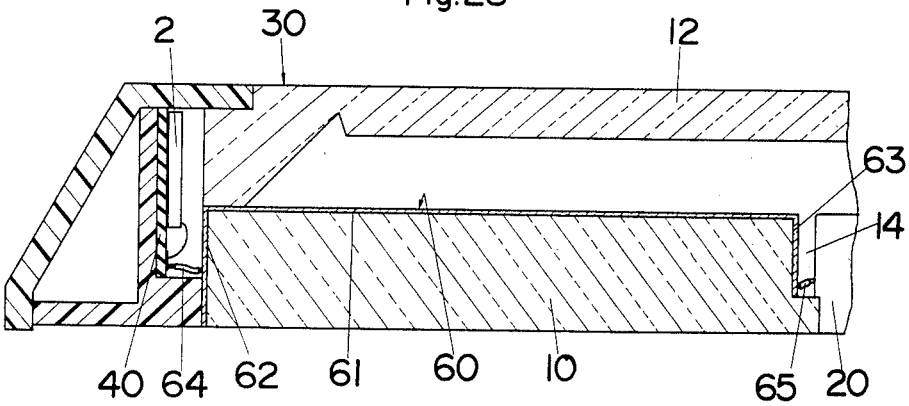
FIG. 28 is a partial view in section of a third embodiment of the present invention.
Figure 29:
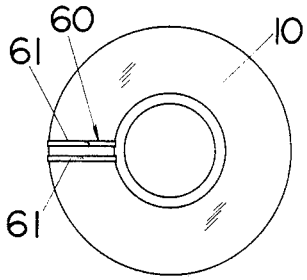
FIG. 29 is a plane view of a base plate with transparent conductor means thereon utilized in the above third embodiment.
Figure 30:
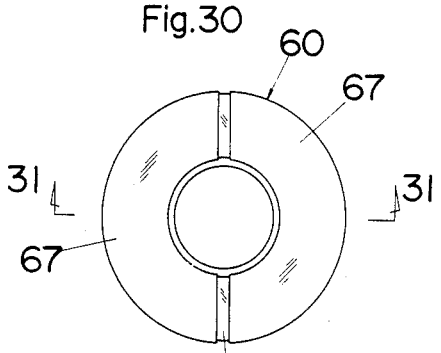
FIG. 30 is a plane view of the base plate with another transparent conductor means which may be adapted for the above third embodiment.
Figure 31:
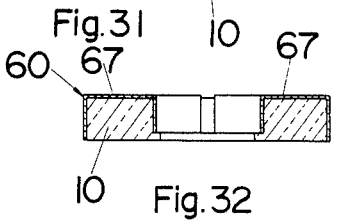
FIG. 31 is a cross section taken along line 31—31 of FIG. 30.
Figure 32:
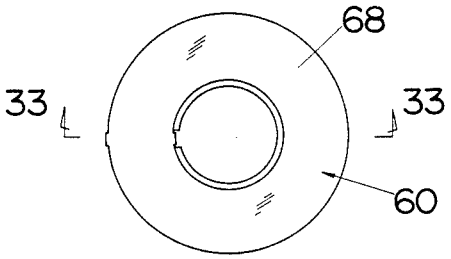
FIG. 32 is a plane view of the base plate with a further transparent conductor means which may be adapted for the above third embodiment.
Figure 33:
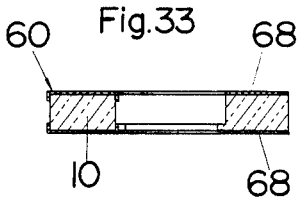
FIG. 33 is a cross section taken along line 33—33 of FIG. 32.

Referring to FIGS. 28 and 29, there is disclosed a third embodiment of the present invention which is similar in construction to the second embodiment except that the face of the timepiece is defined on the base plate 10 itself and transparent conductor means 60 is introduced for electrical connection between the flexible printed wiring 40 and the movement 20. The base plate 10 is made of electrical insulating material to be in the form of annular plate with the center bore 14 for receiving said movement 20. Said transparent conductor means 60 comprises a pair of thin straps 61 carried on the base plate 10 to extend radially thereof, as shown in FIG. 29. The outer end portions 62 of the strap 61 are respectively bent along the outer face of the base plate 10 to be in electrical contact with respective prongs 64 on the lower portion of said flexible printed wiring 40, as the inner end portions 63 of the straps 61 are likewise bent along the inner face of the same to be in electrical contact with respective terminal leads 65 on the side of the movement 20, completing electrical connection between the solar cells 2 and the movement 20. With the use of this transparent conductor means 60 formed on the base plate 10, the face or the upper surface of the base plate 10 is free from any visible wiring which would mar the appearance of the face, resulting in good and neat appearance of the timepiece.

Illustrated in FIGS. 30 through 33 are modifications of the above embodiment, one being characterized in that said transparent conductor means 60 comprises a pair of generally C-shaped thin plates 67, which cover the respective halves of the upper surface of the base plate 10 with narrow gaps therebetween, the other being characterized in that said transparent conductor means 60 comprises a pair of annular thin plates 68, respectively covering the upper and lower surfaces of the base plate 10. These thin plates 67 and 68 have the same end portions as in the above embodiment to complete electrical connection between the solar cells 2 and the movement 20. In the above third embodiment of FIGS. 28 and 29, and the modification of FIGS. 30 and 31, the base plate 10 may be of opaque or transparent material, while the base plate 10 is made of transparent material in the modification of FIGS. 32 and 33.

Figure 34:
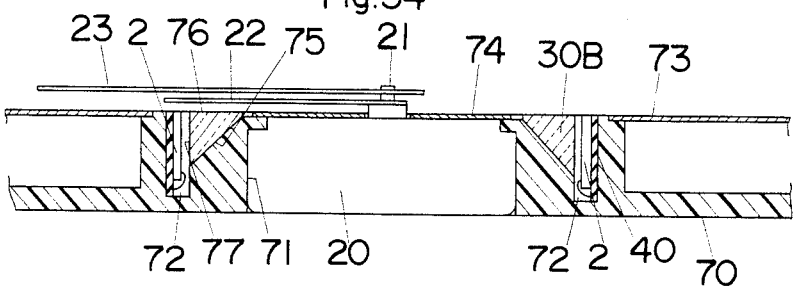
FIG. 34 is a partial view in section of a fourth embodiment of the present invention.

Referring to FIG. 34, there is illustrated a fourth embodiment of the present invention which comprises a base plate 70 with a center bore 71 and an annular groove 72 surrounding that bore 71, and an electrically driven movement 20 which is equivalent in construction to that employed in the above embodiments to have the output drive shaft 21 carrying the hour hand 22 as well as the minute hand 23. Face plates 73 and 74 cover respectively the upper surfaces of the base plate 70 and the movement 20 except for said annular groove 72. The annular groove 72 is formed to have two continuous sections, one being a vertical groove section for receiving a plurality of solar cells 2 held on the flexible printed wiring 40 of the same construction as that employed in the above embodiment, and the other being a triangular section for receiving a reflecting prism 30B serving as the light guide means. The reflecting prism 30B is of right triangular cross section with the hypotenuse being placed on the bottom of said triangular section to define at this boundary the reflecting surface 75, while one of the other two sides is exposed to the upper surface of said face plate 77 and the rest of the two is in parallel confrontation with the light sensitive surfaces of the solar cells 2, so as to respectively define the light entrance surface 76 and the light exit surface 77. The solar cells 2 held in said groove 72 are subjected to the incident light passing through the reflecting prism 30B in much the same way in the above embodiment to produce electric power for driving the movement 20.

Figure 35:
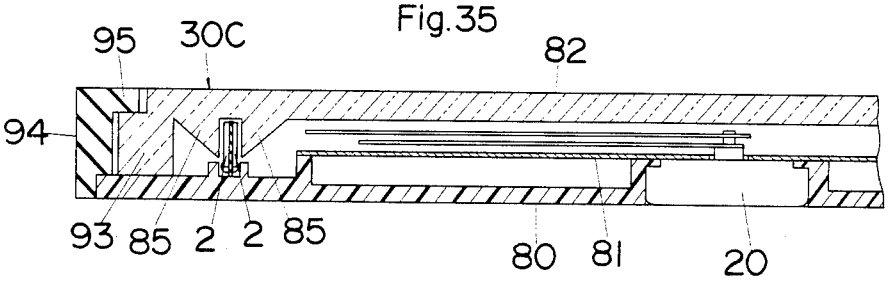
FIG. 35 is a partial view in section of a fifth embodiment of the present invention.
Figure 36:
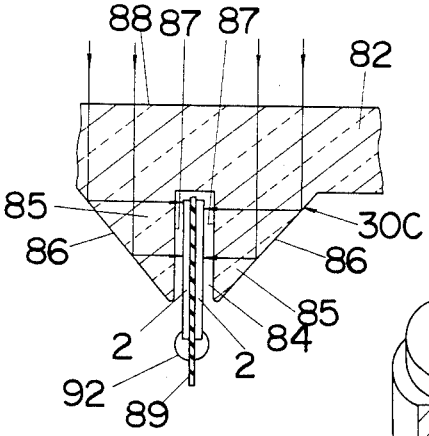
FIG. 36 is an enlarged view illustrating the relationship between the light guide means and the solar cells employed in the embodiment of FIG. 35.
Figure 37:
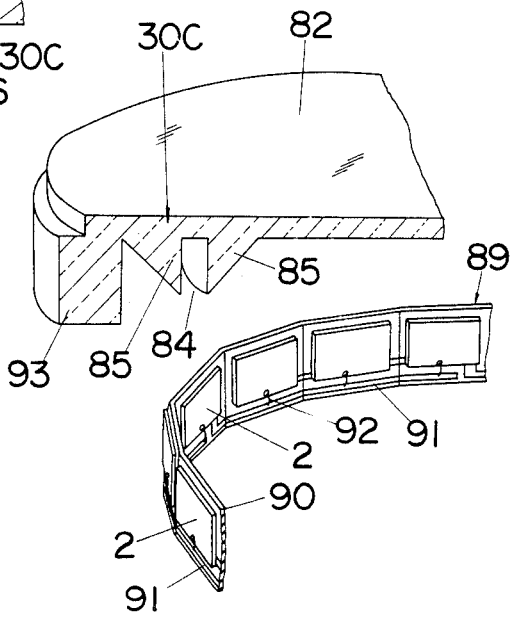
FIG. 37 is an exploded view illustrating top cover including the above light guide means and the solar cells on flexible printed wiring in the embodiment of FIG. 35.
Figure 38:
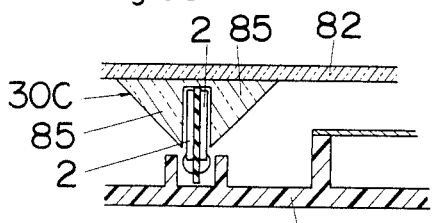
FIG. 38 is a partial view in section illustrating a modification of the above fifth embodiment.

A fifth embodiment of the present invention is illustrated in FIGS. 35 through 37, in which a reflecting prism 30C of unique and useful configuration is disclosed as the light guide means, the other aspects are basically identical to those in the first embodiment. The reflecting prism 30C is integrally formed on the underside of a top cover 82 to extend around a face plate 81 mounted on a base plate 80, and is formed to have a generally triangular cross section with a vertical slit 84 extending from the apex thereof and terminating at the point spaced below the upper surface of the top cover 82. The vertical slit 84 divides the reflecting prism 30C into a pair of opposed sub-prisms 85 each being of right triangular cross section to have one reflection surface 86 and one light exit surface 87. These sub-prisms 85 have a common light entrance surface 88 on the top cover 81 at the area corresponding respectively to the horizontal components of the sub-prisms 85, such that the rays of incident light passing through the light entrance surface 88 will reach the respective reflection surfaces 86 to be reflected therefrom as to proceed towards the respective light exit surfaces 87. Extended into said slit 84 is a flexible printed wiring 89 which is mounted on the base plate 80 and carries on the both sides a plurality of solar cells 2 which are subjected to the rays of incident light passing through the respective sub-prisms 85, as shown by the arrowed lines in FIG. 36. The flexible printed wiring 89 comprises a flexible band 90 of electrical insulating material which has on its opposed sides a plurality of terminal segments 91 of the same configuration as those in the above embodiment, such that the solar cells 2 are connected electrically with each other and at the same time are held on the flexible band 91 with the respective light sensitive surfaces of the solar cells 2 being exposed. The solar cells 2 thus held on the both sides of the flexible printed wiring 89 are arranged within the slit 84 in such a way that the light sensitive surfaces of the solar cells 2 on each side of the wiring 89 face the respective light exit surfaces 87 of the sub-prisms 85, while the lower extremities thereof and the lead wires 92 connecting the solar cells 2 to the terminal segments 91 are out of confrontation with the corresponding light exit surfaces 85. With the combination of the above double-prism construction and the double-sided arrangement of the solar cells 2, a larger number of solar cells 2 can be incorporated within a limited thickness of timepiece, and consequently the time piece can be constructed in a reduced thickness under the retention of producing enough electric power to drive the timepiece. For example, solar cells having a less height than those employed in the above embodiments can be successfully incorporated for the purpose of reducing the thickness of the timepiece. The top cover 81 is provided at its outermost portion with a leg 93, the upper end of which receives the flange 95 of an escutcheon frame 94 and the lower end of which abuts on the base plate 80. The above reflecting prism 30C composed of two sub-prism 85 may be of course formed separately from the top cover 82, such as illustrated in FIG. 38.

Figure 39:
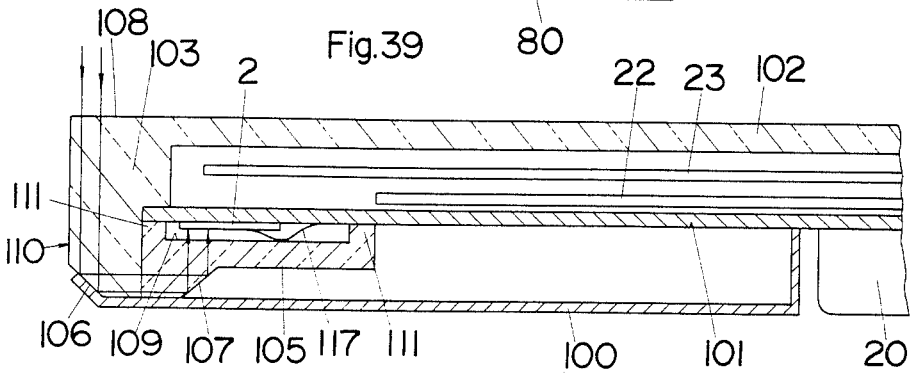
FIG. 39 is a partial view in section of a sixth embodiment of the present invention.
Figure 40:
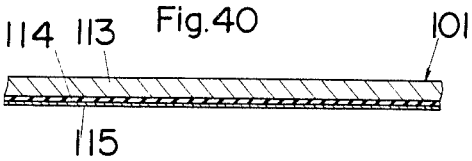
FIG. 40 is a partial view in section of a face plate employed in the embodiment of FIG. 39.
Figure 41:
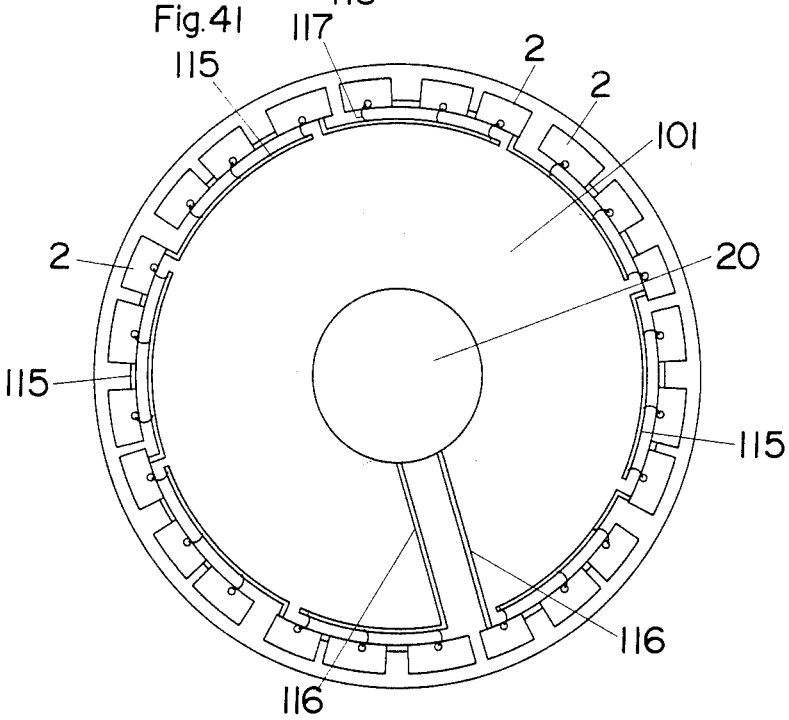
FIG. 41 is a bottom view of the face plate in the embodiment of FIG. 40.

Referring to FIGS. 39 through 41, there is illustrated a sixth embodiment of the present invention wherein a plurality of solar cells 2 are mounted on the underside of a face plate 101 which is in turn mounted on a base plate 100 and which covers the movement 20 disposed at the center portion of the base plate 100. The movement 20 employed is of the same construction as in the above embodiment to be operated by the solar cells 2. A top cover 102 of transparent material are disposed above the face plate 101 to form a space therebetween for the hour hand 22 and minute hand 23 driven by the movement 20. Integrally formed with the top cover 102 is a projection 103 which extends downwardly from the periphery thereof to the portion beyond the face plate 101 so as to join a transparent ring 105 for defining therewith a reflecting prism 110 with two reflection surfaces 106 and 107, which serves as the light guide means to transmit the incident light through a twice deviated or deflected path to the solar cells 2. That is, the projection 103 on the top cover 102 defines a light entrance surface 108 on its upper surface and the first reflection surface 106 on the bevelled portion at its lower end corner, while the transparent ring 105 disposed below the solar cells 2 defines a second reflection surface 107 on the bevelled portion at its lower corner and defines a light exit surface 109 on its upper face which is spaced closely below each of the solar cells 2 in parallel relationship therewith. Also provided on the transparent ring 105 are a pair of radially spaced legs 111 which abut on the underside of the face plate 101 respectively at the portions radially inwardly and outwardly of each solar cell 2, such that the transparent ring 105 is held between the face plate 101 and the base plate 100 against which the lower flattened end of the ring 105 is placed together with the projection 103. Said face plate 101 is, as shown in FIG. 40, a composite plate comprising an aluminum-made substrate 113 with a polished upper surface, an electric insulating layer 114 formed on the entire underside of the substrate 113, and a plurality of terminal segments 115 printed on the insulating layer 114 to be spaced circumferentially along the periphery thereof, as shown in FIG. 41. The terminal segments 115 are of the same functional arrangement as in the afore-said flexible printed wiring of the above embodiment, such as that of FIGS. 6 and 7, to electrically interconnect the solar cells 2 and as well to hold the same on the face plate 101. The output ends of the terminal segments 115 thus combined with the solar cells 2 are connected to the movement 20 by means of a pair of conductors 116 likewise printed on said insulating layer 114. Each lead wire 117 connecting the light sensitive surface of each solar cell 2 to the corresponding terminal segment 115 is also designed to be out of confrontation with the light exit surface 109 so as not to be seen through the reflecting prism 110, just in the same manner as described with respect to the above embodiments. In this embodiment, the face plate 101 is provided on its periphery with time markings (not shown), however, the spacings between the circumferentially spaced solar cells 2 may be utilized to define the time indicia as in the second embodiment in place of the hour markings on the face plate 101.

The above embodiments and particularly the drawings are set forth for purposes of illustration only. It will be understood that many variations and modifications of the embodiment herein described will be obvious to those skilled in the art, and may be carried out without departing from the spirit and scope of the invention.

What is claimed is:

1. A timepiece operated by solar cells comprising:

a base plate defining thereon a face of the timepiece;

a time indicating means comprising at least an hour hand and a minute hand respectively overlying said face on the base plate;

a plurality of flat shaped solar cells mounted on the base plate for energizing said movement, said solar cells being circumferentially spaced along the periphery of said face of said timepiece with the major surfaces of each solar cell being perpendicular to and in a same radial direction of the base plate, said major surfaces of each solar cell defining respectively the light sensitive surface and the opposite surface;

an electrically driven movement provided at the center portion of the base plate for being powered by the solar cells to rotate said hour and minute hand about the center axis of the base plate;

a reflecting prism extending along the periphery of said face and mounted on the base plate for deviatedly transmitting incident light to each of the solar cells, said reflecting prism having a light entrance surface exposed to a top surface of the timepiece for receiving incident light, at least one reflection surface provided at such a relationship to said entrance surface for deviating or changing the course of the incident light, and at least one light exit surface which is parallel to and confronts closely the light sensitive surface of each solar cell and through which the incident light which enters said light entrance surface and is reflected by said reflection surface is transmitted to the major light sensitive surface of each solar cell;

a terminal means extending along the periphery of said face so as to be electrically connected to said solar cells for delivering the electric power produced in the solar cells to said movement, said terminal means having a pair of first and second terminal areas which are respectively electrically connected to the light sensitive surface and the opposite surface of each solar cell, said first terminal area being connected by lead wires to each light sensitive surface at such location that both the first terminal area and the lead wires are out of confrontation with said light exit surface of the reflecting prism and said second terminal area being mechanically coupled to said opposite surface of each solar cell; and a pair of transparent conductor means provided on the base plate to electrically interconnect said terminal means and the movement.

2. A timepiece as set forth in claim 1, wherein the base plate is made of a transparent material.

3. A timepiece as set forth in claim 1, including a top cover of transparent material disposed above the face of the timepiece, and wherein said reflecting prism which is formed separately from the top cover is attached to the underside of the top cover so as to surround the face of the timepiece.

4. A timepiece as set forth in claim 1, including a top cover of transparent material which is disposed above the face of the timepiece and with which said reflecting prism is integrally formed to surround the face of the timepiece.

5. A timepiece as set forth in claim 4, wherein said reflecting prism is formed by an integral projection on the underside of the top cover to define the light entrance surface of the reflecting prism on the top face of the top cover at the location just above said integral projection, the integral projection having an outer side face which defines the light exit surface of the reflecting prism and faces closely to the light sensitive surface of each solar cell, and having an inner oblique side face, and wherein the top cover is provided in its lower surface with an annular notch of generally V-shaped cross section, the outer side wall of which is coplanar and cooperative with said inner oblique side face of the projection to define the reflection surface of the reflecting prism.

6. A timepiece as set forth in claim 1, wherein said terminal means is a flexible printed wiring comprising a flexible band with a plurality of terminal segments printed on one side thereof and extending substantially the entire length of that band, said solar cells being secured on the conductor side of the band to be electrically connected respectively to the terminal segments in such a way that one of the solar cells bridges the both longitudinal ends of the band to form it in the shape of an annular band with the circumferentially spaced solar cells on one side thereof.

7. A timepiece as set forth in claim 6, wherein said terminal segments have a plurality of throughholes open to the non-conductor side of the flexible printed wiring, each of said throughholes being filled with a solder for joining each solar cell and the flexible band.

8. A timepiece as set forth in claim 6, wherein said solar cells are circumferentially spaced in such a way as to define on the surface of said flexible band at the portions between selected pairs of adjacent solar cells time indicias which are equiangularly spaced along the periphery of the face of the timepiece, such time indicia on the flexible band appearing on the light entrance surface of the reflecting prism.

9. A timepiece as set forth in claim 7, wherein said flexible band is tinted in a color at the portions defining said time indicias, such color being different from that of the solar cells and that of the other portions of the flexible band.

* * * * *